US011262110B2

(12) United States Patent
Shen et al.

(10) Patent No.: US 11,262,110 B2
(45) Date of Patent: Mar. 1, 2022

(54) HEAT DISSIPATION MODULE AND HEAT DISSIPATION METHOD THEREOF

(71) Applicant: Wistron Corporation, New Taipei (TW)

(72) Inventors: Chih-Teng Shen, New Taipei (TW); Liang-Fang Wan, New Taipei (TW)

(73) Assignee: Wistron Corporation, New Taipei (TW)

( * ) Notice: Subject to any disclaimer, the term of this patent is extended or adjusted under 35 U.S.C. 154(b) by 141 days.

(21) Appl. No.: 16/364,193

(22) Filed: Mar. 26, 2019

(65) Prior Publication Data

US 2020/0224933 A1 Jul. 16, 2020

(30) Foreign Application Priority Data

Jan. 15, 2019 (TW) ..... 108101555

(51) Int. Cl.
*F25B 21/02* (2006.01)
*F25B 21/04* (2006.01)

(52) U.S. Cl.
CPC ..... *F25B 21/02* (2013.01); *F25B 2321/025* (2013.01); *F25B 2321/0212* (2013.01)

(58) Field of Classification Search
CPC .... F25B 21/02; F25B 21/04; F25B 2321/025; F25B 2321/0251; F25B 2321/0252; H05K 2201/10219; F24F 1/0378
See application file for complete search history.

(56) References Cited

U.S. PATENT DOCUMENTS 5,590,532 A * 1/1997 Bachman ..... B67D 1/0869 62/3.3
5,711,155 A * 1/1998 DeVilbiss ..... A61F 7/0085 62/3.3
6,902,648 B2 * 6/2005 Numata ..... H01J 37/32522 118/723 E
7,495,400 B2 2/2009 Testin
9,759,458 B2 9/2017 Nakajima
(Continued)

FOREIGN PATENT DOCUMENTS

CN 1902557 1/2007
CN 100495279 6/2009
(Continued)

OTHER PUBLICATIONS

"Office Action of Taiwan Counterpart Application," dated Jul. 15, 2019, p. 1-p. 7.
(Continued)

*Primary Examiner* — Jianying C Atkisson
*Assistant Examiner* — Erik Mendoza-Wilkenfel
(74) *Attorney, Agent, or Firm* — JCIPRNET

(57) ABSTRACT

A heat dissipation module and a heat dissipation method thereof are provided. A cold side of a thermoelectric cooler is disposed on a heat conducting member. A processing circuit controls a voltage control circuit to provide an output voltage to the thermoelectric cooler according to a temperature sensing signal generated by a temperature sensor sensing a temperature of the heat conducting member, so as to adjust a temperature of the cold side of the thermoelectric cooler to dissipate heat for a heat source.

7 Claims, 5 Drawing Sheets

(56) References Cited

U.S. PATENT DOCUMENTS

| | | | | |
|---|---|---|---|---|
| 2002/0038550 | A1* | 4/2002 | Gillen | F25B 21/04 62/3.7 |
| 2006/0173344 | A1* | 8/2006 | Marian | F28D 15/00 600/459 |
| 2007/0182608 | A1 | 8/2007 | Testin | |
| 2012/0152511 | A1* | 6/2012 | Chang | F28D 20/028 165/202 |
| 2015/0121899 | A1 | 5/2015 | Nakajima | |
| 2018/0031285 | A1* | 2/2018 | Thomas | F25D 17/06 |

FOREIGN PATENT DOCUMENTS

| | | |
|---|---|---|
| CN | 104635784 | 5/2015 |
| JP | 2004319628 | 11/2004 |
| JP | 2008216088 | 9/2008 |
| JP | 2015033182 | 2/2015 |
| TW | 201525640 | 7/2015 |
| TW | 201833654 | 9/2018 |

OTHER PUBLICATIONS

"Office Action of Taiwan Counterpart Application", dated May 25, 2020, p. 1-p. 8.
"Office Action of Japan Counterpart Application", dated Sep. 1, 2020, p. 1-p. 7.
"Office Action of China Counterpart Application", dated Apr. 6, 2021, p. 1-p. 11.

* cited by examiner

HEAT DISSIPATION MODULE AND HEAT DISSIPATION METHOD THEREOF

CROSS-REFERENCE TO RELATED APPLICATION

This application claims the priority benefit of Taiwan application serial no. 108101555, filed on Jan. 15, 2019. The entirety of the above-mentioned patent application is hereby incorporated by reference herein and made a part of this specification.

BACKGROUND OF THE INVENTION

Field of the Invention

The disclosure relates to a heat dissipation module and a heat dissipation method thereof, and more particularly, to a high-efficiency heat dissipation module and a heat dissipation method thereof.

Description of Related Art

With the advancement and demand of technology, a lot of simulation software, graphics software, and game software require high-performance computing capacity and a lot of central processing unit (CPU) resources, either in a desktop or a laptop. In order to improve the working efficiency of the CPU in response to highly complex computations and operations, operating and maintaining the CPU at a high clock rate will be the direction of development to work on. In order to operate the CPU at the high clock rate and maintain the clock at the limit of the chip or greater than the upper-limit clock of the chip (i.e., overclocking, OC), the heat source generated by the chipset also needs to be quickly carried away and dissipated. Once the rated compatible tolerance temperature of the chipset is exceeded, the system may experience abnormalities of uncertainty. Therefore, in order to achieve system stability and maintain high clock rate working efficiency output, a more efficient and stable heat dissipation module becomes an important issue.

The early heat dissipation modules mostly used air at the room temperature as the medium. As the heat dissipation module evolved, the heat dissipation module has come to be applied to computers. Later, according to users' demand, heat dissipation modules that dissipate heat through air cooling or liquid cooling or both have evolved. However, since the air cooling method uses air at a normal temperature (e.g., 25°) as the medium, its heat dissipation efficiency is limited. When the CPU needs to operate instantaneously at a rated frequency greater than that of the specification, the heat source and wattage generated at the moment will be instantaneously greater than the thermal design power (TDP). At this time, if heat is dissipated only through air at the normal temperature, the dissipation effect of the high temperature instantaneously generated by the CPU is relatively limited. In the current heat dissipation module control methods of the computer systems, the fan speed is controlled by switching when a predetermined temperature is reached. Such a fan speed control method not only fails to respond in real time, but is also likely to have switching losses of the switch that cannot be precisely controlled.

In addition, the volume of the heat dissipation module currently available cannot be adjusted according to the user's requirement. When there is requirement for a higher performance and a higher frequency, it is necessary to have a larger heat dissipation area on the heat dissipation module to increase the heat dissipation capability, which results in the need to redesign the heat dissipation module and further increases the design cost.

SUMMARY OF THE INVENTION

The invention provides a heat dissipation module and a heat dissipation method thereof that can effectively improve the heat dissipation efficiency.

A heat dissipation module of the invention is adapted to dissipate heat for a heat source. The heat dissipation module includes a heat conducting member, a voltage control circuit, a thermoelectric cooler, a temperature sensor, and a processing circuit. The heat conducting member is connected to the heat source. The voltage control circuit provides an output voltage. The thermoelectric cooler is coupled to the voltage control circuit. A cold side of the thermoelectric cooler is disposed on the heat conducting member. The thermoelectric cooler adjusts a temperature of the cold side according to the output voltage. The temperature sensor senses a temperature of the heat conducting member to generate a temperature sensing signal. The processing circuit is coupled to the voltage control circuit and the temperature sensor and outputs a control signal according to the temperature sensing signal to control a voltage value of the output voltage generated by the voltage control circuit to adjust the temperature of the cold side to dissipate heat for the heat source.

In an embodiment of the invention, the heat conducting member includes a metal container. The heat dissipation module further includes a liquid cooling device, which provides a circulation pipe including a cooling liquid. The circulation pipe connects the metal container and the heat source.

In an embodiment of the invention, the liquid cooling device further includes a heat dissipation device and a pump. The heat dissipation device is connected to the circulation pipe and dissipates heat for the cooling liquid. The pump is connected to the circulation pipe and drives the cooling liquid to flow in the circulation pipe.

In an embodiment of the invention, the heat dissipation device includes a fan.

In an embodiment of the invention, the heat dissipation module further includes a heat dissipation device, which is disposed on a hot side of the thermoelectric cooler and dissipates heat for the hot side of the thermoelectric cooler.

In an embodiment of the invention, the heat dissipation device includes a fan.

In an embodiment of the invention, the processing circuit stores a temperature voltage table. The temperature voltage table includes a correspondence between a temperature value of the temperature sensing signal and a voltage value of a target output voltage of the voltage control circuit. The processing circuit controls the voltage control circuit to generate the output voltage according to the temperature voltage table and the temperature sensing signal.

In an embodiment of the invention, the processing circuit includes an embedded control chip.

A heat dissipation method of a heat dissipation module of the invention is adapted to dissipate heat for a heat source. The heat dissipation module includes a thermoelectric cooler and a heat conducting member. The heat conducting member is connected to the heat source. A cold side of the thermoelectric cooler is disposed on the heat conducting member. The heat dissipation method of the heat dissipation module includes the following steps. A temperature of the heat conducting member is sensed to generate a temperature sensing signal. A control voltage output to the thermoelectric cooler is adjusted according to the temperature sensing signal to adjust a temperature of the cold side to dissipate heat for the heat source.

In an embodiment of the invention, the heat conducting member includes a metal container. The heat dissipation module further includes a liquid cooling device. The liquid cooling device provides a circulation pipe including a cooling liquid. The circulation pipe connects the metal container and the heat source.

Based on the above, the processing circuit of the invention controls the voltage control circuit to provide the output voltage to the thermoelectric cooler according to the temperature sensing signal generated by the temperature sensor sensing the temperature of the heat conducting member, so as to adjust the temperature of the cold side of the thermoelectric cooler to dissipate heat for the heat source. By providing the output voltage to the thermoelectric cooler according to the temperature sensing signal in this manner, the output voltage provided to the thermoelectric cooler can be constantly precisely adjusted in response to the temperature change to thereby effectively dissipate heat for the heat source and improve the heat dissipation efficiency of the heat dissipation module. In addition, the cold side of the thermoelectric cooler can be prevented from constantly operating at an ultra-low temperature, which would cause condensation of water on the cold side and thereby cause damage to the system or electronic device using the heat dissipation module.

To make the aforementioned more comprehensible, several embodiments accompanied with drawings are described in detail as follows.

DESCRIPTION OF THE EMBODIMENTS

Figure 1:
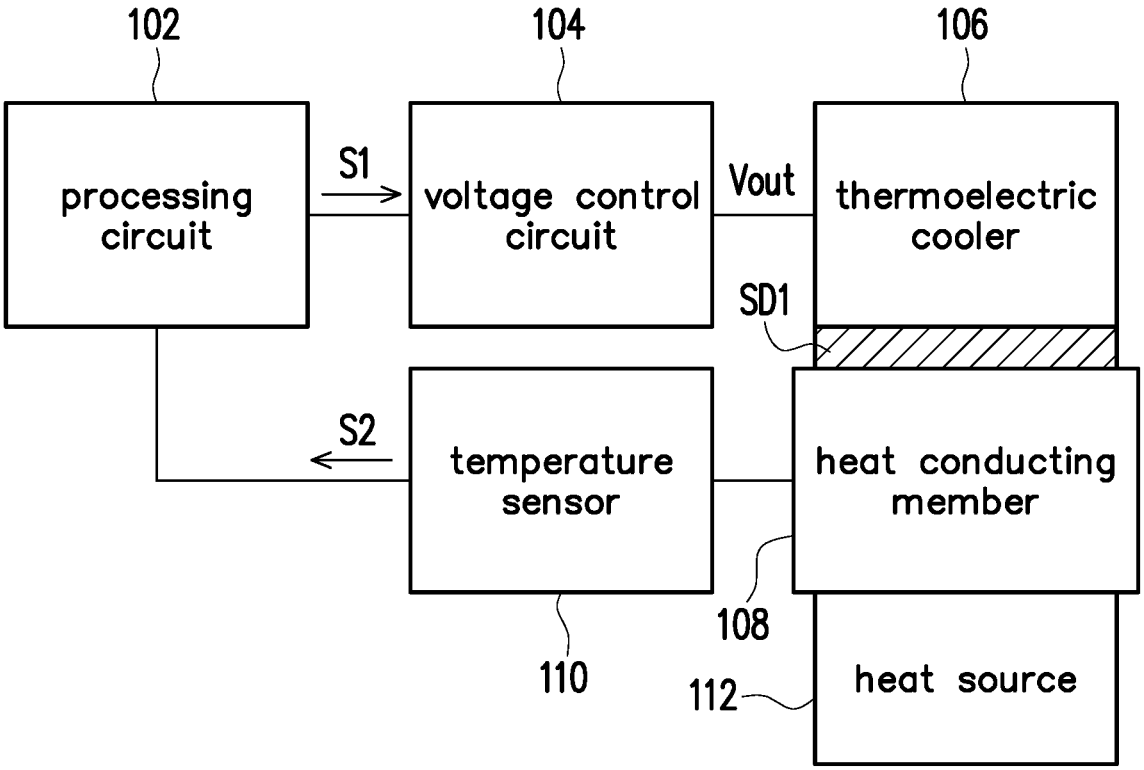
FIG. 1 is a schematic view of a heat dissipation module according to an embodiment of the invention.

FIG. 1 is a schematic view of a heat dissipation module according to an embodiment of the invention. Referring to FIG. 1, the heat dissipation module may include a processing circuit 102, a voltage control circuit 104, a thermoelectric cooler 106, a heat conducting member 108, and a temperature sensor 110. The heat conducting member 108 is connected to a heat source 112, and the heat source 112 may be, for example, a device that generates thermal energy during operation such as a CPU or a display chip, but the invention is not limited thereto. The heat conducting member 108 may include, for example, a metal material having a high thermal conductivity such as an aluminum alloy, a silver alloy, or a copper alloy. The voltage control circuit 104 is coupled to the processing circuit 102 and the thermoelectric cooler 106. A cold side SD1 of the thermoelectric cooler 106 is disposed on the heat conducting member 108. Moreover, the processing circuit 102 is further coupled to the temperature sensor 110.

The temperature sensor 110 may sense the temperature of the heat conducting member 108 to generate a temperature sensing signal S2. The processing circuit 102 may be, for example, an embedded control chip, which can generate a control signal S1 according to the temperature sensing signal S2. The voltage control circuit 104 may generate a voltage value of an output voltage Vout for the thermoelectric cooler 106 according to the control signal S1. The thermoelectric cooler 106 may have a hot side and a cold side according to the received voltage. The higher the voltage received by the thermoelectric cooler 106 is higher, the greater the temperature difference between the hot side and the cold side is, and namely, the lower the temperature of the cold side is and the higher the temperature of the hot side is. In the present embodiment, the thermoelectric cooler 106 can adjust the temperature of the cold side SD1 of the thermoelectric cooler 106 according to the output voltage Vout to adjust the temperature of the heat conducting member 108 to dissipate heat for the heat source 112. For example, when the heat source 112 is a CPU operating at a high frequency and a high performance, the thermoelectric cooler 106 can effectively reduce the temperature of the CPU through the heat conducting member 108, so that the CPU can normally operate at the high frequency and the high performance.

Figure 2:
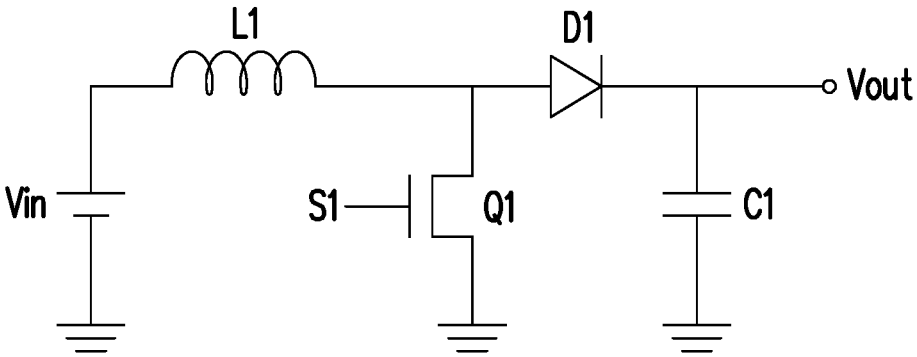
FIG. 2 is a schematic view of a voltage control circuit according to an embodiment of the invention.

Specifically, the implementation of the voltage control circuit 104 may be as shown in FIG. 2, for example. The voltage control circuit 104 may include an input power Vin, an inductor L1, a transistor Q1, a rectifier diode D1, and a capacitor C1. The input power Vin is coupled between the first terminal of the inductor L1 and the ground, the second terminal of the inductor L1 is coupled to the anode of the rectifier diode D1, the transistor Q1 is coupled between the second terminal of the inductor L1 and the ground, and the gate of the transistor Q1 is coupled to the processing circuit 102 to receive the control signal S1. The cathode of the rectifier diode D1 is coupled to the output terminal of the voltage control circuit 104. Moreover, the capacitor C1 is coupled between the cathode of the rectifier diode D1 and the ground.

The inductor L1 has a function of storing energy. When the transistor Q1 is turned on, the input power Vin can continuously cause the inductor L1 to accumulate electric energy, and when the transistor Q1 is turned off, the current will flow through the rectifier diode D1 to charge the capacitor C1. By controlling the transistor Q1 to switch between the on state and the off state through the control signal S1 (in the present embodiment, the control signal S1 is a pulse width modulation signal), it is possible to accumulate energy and determine the voltage value of the output voltage Vout through continuous charging and discharging.

The temperature of the heat conducting member 108 rises after the system using the heat dissipation module is operated for a long time or if the system needs to operate at a high performance. The temperature sensor 110 may sense the temperature of the heat conducting member 108 and generate the temperature sensing signal S2 to be transmitted back to the processing circuit 102. The processing circuit 102 can re-adjust the duty ratio of the pulse width modulation signal (the control signal S1) by using an internal algorithm according to the temperature sensing signal S2, and output the pulse width modulation signal re-adjusted by the internal algorithm to the transistor Q1 in the voltage control circuit 104, so that the voltage control circuit 104 can stably provide the output voltage Vout to the thermoelectric cooler 106 to cause the thermoelectric cooler 106 to reduce the temperature of the cold side SD1 to dissipate heat for the heat source 112 (e.g., the CPU). By constantly performing temperature detection and adjusting the output voltage Vout of the voltage control circuit 104 in this manner, the CPU can be effectively enabled to achieve the highest performance output.

In addition, to avoid switch-type switching losses, the relationship between the target output voltage of the voltage control circuit 104 and the temperature of the heat conducting member 108 (i.e., the temperature value of the temperature sensing signal S2) may be stored as a table in the processing circuit 102, for example, and the temperature and voltage information in the table may be self-defined according to experimental data to achieve optimal temperature control effect. The processing circuit 102 may directly control the voltage control circuit 104 to generate the output voltage Vout according to the temperature sensing signal S2 and the relationship between the target output voltage of the voltage control circuit 104 and the temperature of the heat conducting member 108 in the table. The table of the relationship between the target output voltage of the voltage control circuit 104 and the temperature of the heat conducting member 108 may be, for example, the table as shown below.

TABLE 1

| Temperature of heat conducting member (° C.) | Target temperature (° C.) | Target output voltage (V) | CPU performance |
|---|---|---|---|
| 99 | 15 | 18 | High |
| 95 | 15 | 17 | High |
| 85 | 15 | 16.8 | High |
| 80 | 20 | 16.2 | Balance |
| 70 | 20 | 15.8 | Balance |
| 60 | 20 | 15.2 | Balance |
| 50 | 25 | 14.5 | Balance |
| 40 | 25 | 14.1 | Low |
| 30 | 25 | 13.4 | Low |

Figure 3:
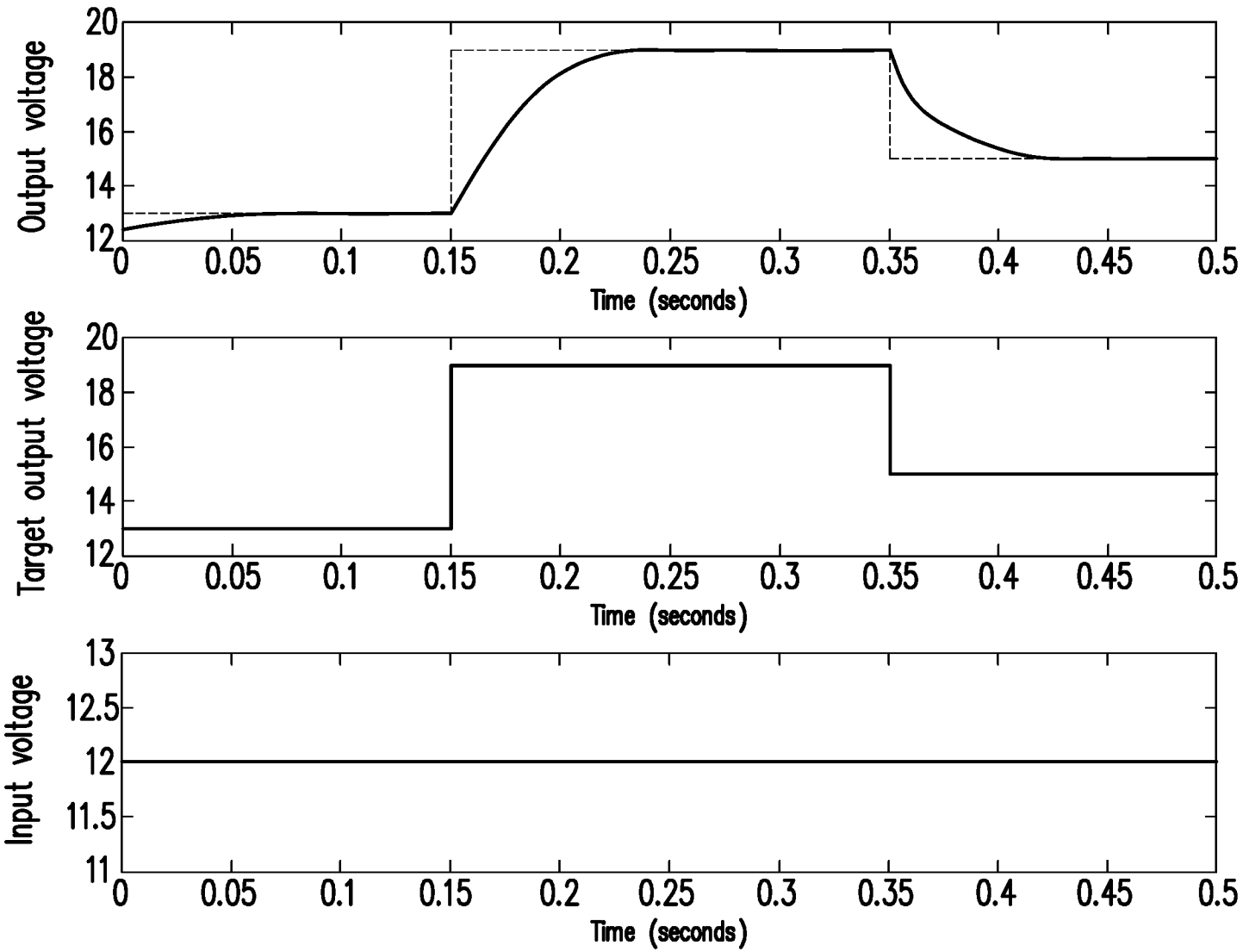
FIG. 3 is a waveform diagram of an output voltage and a target output voltage of the voltage control circuit, and an input voltage of the input power according to an embodiment of the invention.

Generally, the temperature change of the CPU (the heat source 112) exhibits uncertainty, and the temperature change will indirectly affect the output voltage Vout of the voltage control circuit. By controlling the output voltage Vout by using the recited table of the relationship between the target output voltage of the voltage control circuit 104 and the temperature of the heat conducting member 108, the temperature adjustment control on the thermoelectric cooler 106 can be effectively optimized to enable the CPU to operate at its optimal performance. For example, FIG. 3 is a waveform diagram of an output voltage and a target output voltage of the voltage control circuit, and an input voltage of the input power Vin according to an embodiment of the invention. In the embodiment of FIG. 3, the temperature of the heat conducting member 108 rises from 30 degrees to 99 degrees and then drops to 60 degrees due to the temperature change of the CPU. As can be seen from FIG. 3, the processing circuit 102 can sequentially set the target output voltage of the voltage control circuit 104 to 13.4 V, 18 V, and 15.2 V (corresponding to target temperatures of 25 degrees, 15 degrees, and 20 degrees of the thermoelectric cooler 106) according to the temperature sensing signal S2 and the information in Table 1 in response to the temperature change of the CPU. As can be seen from the waveform of the output voltage in FIG. 3, the output voltage Vout of the voltage control circuit 104 indeed reflects the temperature change of the CPU and quickly reaches the target output voltage and can thus effectively perform precise temperature control on the thermoelectric cooler 106. In addition, the cold side of the thermoelectric cooler 106 can be prevented from constantly operating at an ultra-low temperature, which would cause condensation of water on the cold side SD1 and thereby cause damage to the system or electronic device using the heat dissipation module.

Figure 4:
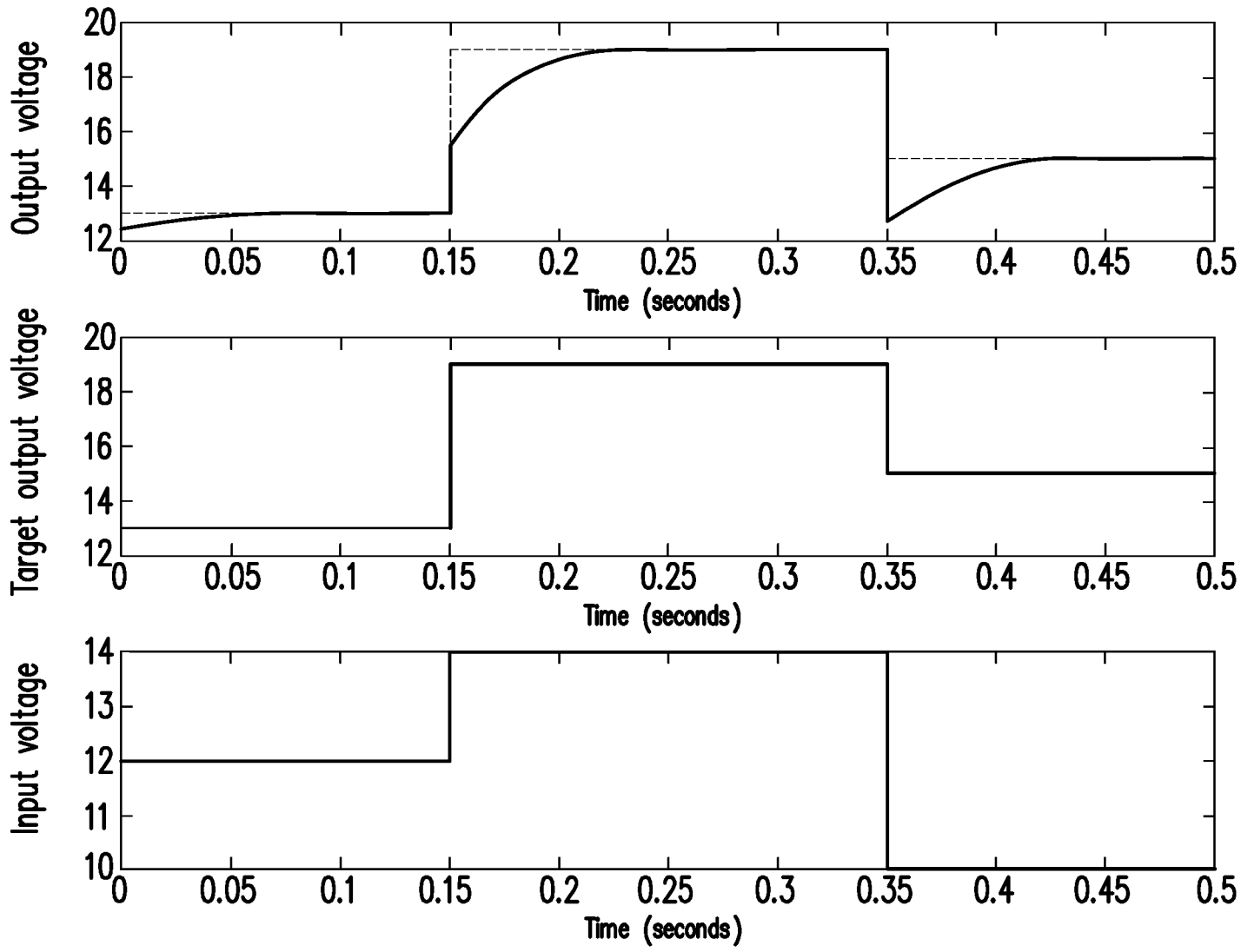
FIG. 4 is a waveform diagram of an output voltage and a target output voltage of the voltage control circuit, and an input voltage of the input power according to another embodiment of the invention.

As another example, FIG. 4 is a waveform diagram of an output voltage and a target output voltage of the voltage control circuit, and an input voltage of the input power Vin according to another embodiment of the invention. In the embodiment of FIG. 4, the temperature of the heat conducting member 108 also rises from 30 degrees to 99 degrees and then drops to 60 degrees due to the temperature change of the CPU, but the input voltage of the input power Vin experiences fluctuations due to an uncertain factor. As can be seen from FIG. 4, the processing circuit 102 can still precisely control the output voltage of the voltage control circuit 104 according to the temperature sensing signal S2 and the information in Table 1 to effectively cause the thermoelectric cooler 106 to dissipate heat in response to the temperature change of the CPU.

Since the processing circuit 102 of the above embodiments can adjust the temperature of the cold side SD1 of the thermoelectric cooler 106 in response to the temperature change of the CPU, even if the CPU is upgraded such that the operating temperature is significantly increased, the heat dissipation module can still effectively dissipate heat by further reducing the temperature of the cold side SD1 of the thermoelectric cooler 106, which thus solves the issue in the conventional art that the heat dissipation module has to be redesigned.

Figure 5:
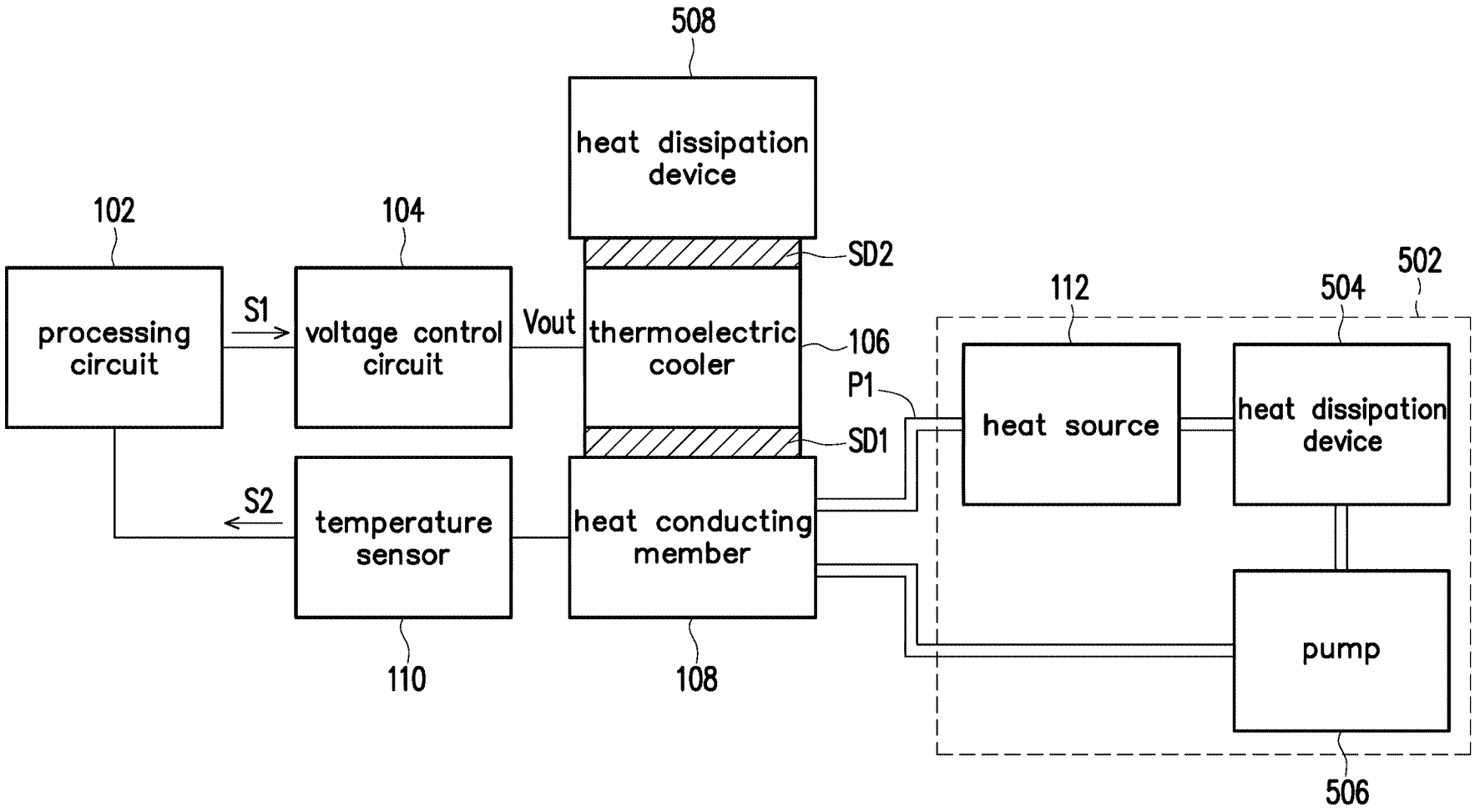
FIG. 5 is a schematic view of a heat dissipation module according to another embodiment of the invention.

FIG. 5 is a schematic view of a heat dissipation module according to another embodiment of the invention. Referring to FIG. 5, compared to the embodiment of FIG. 1, the heat dissipation module of the present embodiment further includes a liquid cooling device 502. The liquid cooling device 502 may provide a circulation pipe P1 including a cooling liquid, and the circulation pipe P1 is connected to the heat conducting member 108. In the present embodiment, the heat conducting member 108 is a metal container. Specifically, the liquid cooling device 502 further includes a heat dissipation device 504 and a pump 506. The circulation pipe P1 may sequentially connect the heat conducting member 108, the heat source 112, the heat dissipation device 504, and the pump 506. The pump 506 may drive the cooling liquid to flow in the circulation pipe P1. The heat dissipation device 504 may be, for example, a fan that dissipates heat for the cooling liquid in the circulation pipe P1 to reduce the temperature of the cooling liquid that has increased as a result of carrying away the thermal energy of the heat source 112. Moreover, the cold side SD1 of the thermoelectric cooler 106 may also cool the cooling liquid through reducing the temperature of the heat conducting member 108, so that the cooling liquid can more effectively dissipate heat for the heat source 112. Since the temperature control method of the thermoelectric cooler 106 in the present embodiment is the same as that in the above embodiments, the implementation details thereof shall not be repeatedly described herein. In addition, the heat dissipation module may further include another heat dissipation device 508. The heat dissipation device 508 is disposed on a hot side SD2 of the thermoelectric cooler 106, and the heat dissipation device 508 may be implemented as, for example, a fan but is not limited thereto. By dissipating heat for the hot side SD2 of the thermoelectric cooler 106 through the heat dissipation device 508, the operation performance of the thermoelectric cooler 106 can be further improved.

Figure 6:
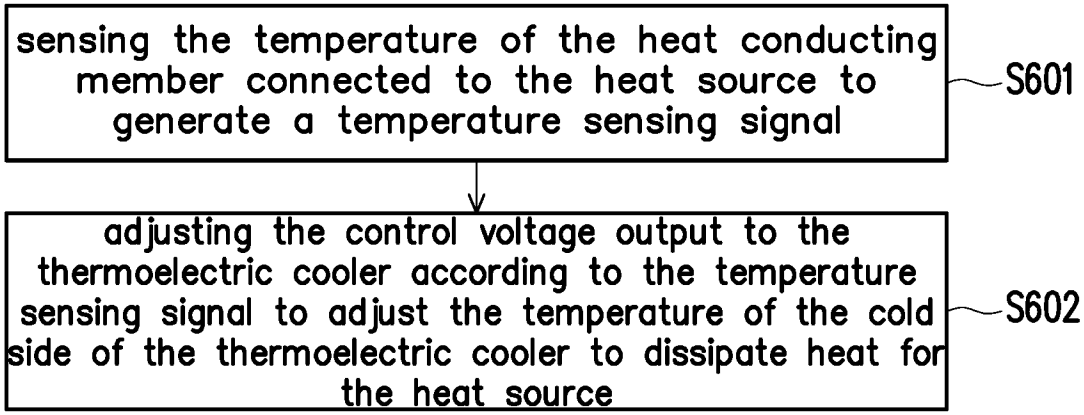
FIG. 6 is a flowchart of a heat dissipation method of a heat dissipation module according to an embodiment of the invention.

FIG. 6 is a flowchart of a heat dissipation method of a heat dissipation module according to an embodiment of the invention. Referring to FIG. 6, as can be seen from the above embodiments, the heat dissipation method of the heat dissipation module may include the following steps. First, the temperature of the heat conducting member is sensed to generate a temperature sensing signal (step S601), wherein the heat conducting member is connected to the heat source. In some embodiments, the heat conducting member may be, for example, a metal container that may be connected to the circulation pipe in the liquid cooling device of the heat dissipation module. Next, the control voltage output to the thermoelectric cooler is adjusted according to the temperature sensing signal to adjust the temperature of the cold side to dissipate heat for the heat source (step S602). By providing the output voltage to the thermoelectric cooler according to the temperature sensing signal in this manner, the output voltage provided to the thermoelectric cooler can be constantly precisely adjusted in response to the temperature change to thereby effectively dissipate heat for the heat source and improve the heat dissipation efficiency of the heat dissipation module.

In summary of the above, the processing circuit of the invention controls the voltage control circuit to provide the output voltage to the thermoelectric cooler according to the temperature sensing signal generated by the temperature sensor sensing the temperature of the heat conducting member, so as to adjust the temperature of the cold side of the thermoelectric cooler to dissipate heat for the heat source. By providing the output voltage to the thermoelectric cooler according to the temperature sensing signal in this manner, the output voltage provided to the thermoelectric cooler can be constantly precisely adjusted in response to the temperature change to thereby effectively dissipate heat for the heat source and improve the heat dissipation efficiency of the heat dissipation module. In addition, the cold side of the thermoelectric cooler can be prevented from constantly operating at an ultra-low temperature, which would cause condensation of water on the cold side and thereby cause damage to the system or electronic device using the heat dissipation module.

It will be apparent to those skilled in the art that various modifications and variations can be made to the disclosed embodiments without departing from the scope or spirit of the disclosure. In view of the foregoing, it is intended that the disclosure covers modifications and variations provided that they fall within the scope of the following claims and their equivalents.

What is claimed is:

1. A heat dissipation module adapted to dissipate heat for a heat source, the heat dissipation module comprising:

a heat conducting member, connected to the heat source, wherein the heat conducting member comprises a metal container;

a liquid cooling device comprising a circulation pipe with a cooling liquid flowing within the circulation pipe, wherein the circulation pipe connects the metal container and the heat source;

a voltage control circuit, providing an output voltage;

a thermoelectric cooler, coupled to the voltage control circuit, wherein a cold side of the thermoelectric cooler is disposed on the heat conducting member, and the thermoelectric cooler adjusts a temperature of the cold side according to the output voltage;

a temperature sensor, sensing a temperature of the heat conducting member to generate a temperature sensing signal; and a processing circuit, coupled between the voltage control circuit and the temperature sensor and outputting a control signal according to the temperature sensing signal to control a voltage value of the output voltage generated by the voltage control circuit to adjust the temperature of the cold side to dissipate heat for the heat source, wherein the processing circuit stores a temperature voltage table, the temperature voltage table comprises a correspondence between a temperature value of the temperature sensing signal, a voltage value of the output voltage of the voltage control circuit and a CPU performance status, and the CPU performance status varies between High, Balance, and Low, wherein the processing circuit controls the voltage control circuit to generate the output voltage according to the temperature voltage table and the temperature sensing signal in response to a status variation of the CPU performance status.

2. The heat dissipation module according to claim 1, wherein the liquid cooling device further comprises:

a heat dissipation device, connected to the circulation pipe and dissipating heat for the cooling liquid; and a pump, connected to the circulation pipe and driving the cooling liquid to flow in the circulation pipe.

3. The heat dissipation module according to claim 2, wherein the heat dissipation device comprises a fan.

4. The heat dissipation module according to claim 1, further comprising:

a heat dissipation device, disposed on a hot side of the thermoelectric cooler and dissipating heat for the hot side of the thermoelectric cooler.

5. The heat dissipation module according to claim 4, wherein the heat dissipation device comprises a fan.

6. The heat dissipation module according to claim 1, wherein the processing circuit comprises an embedded control chip.

7. A heat dissipation method of a heat dissipation module, adapted to dissipate heat for a heat source, wherein the heat dissipation module comprises a thermoelectric cooler and a heat conducting member, the heat conducting member is connected to the heat source, the heat conducting member comprises a metal container, and a cold side of the thermoelectric cooler is disposed on the heat conducting member, the heat dissipation method of the heat dissipation module comprising:

sensing a temperature of the heat conducting member by a temperature sensor to generate a temperature sensing signal; and adjusting a control voltage output to the thermoelectric cooler by a processing circuit according to the temperature sensing signal to adjust a temperature of the cold side to dissipate heat for the heat source, wherein a liquid cooling device comprising a circulation pipe with a cooling liquid flowing within the circulation pipe, wherein the circulation pipe connects the metal container and the heat source, wherein the processing circuit stores a temperature voltage table, the temperature voltage table comprises a correspondence between a temperature value of the temperature sensing signal, a voltage value of the output voltage of a voltage control circuit and a CPU performance status, and the CPU performance status varies between High, Balance, and Low, wherein the processing circuit controls the voltage control circuit to generate the output voltage according to the temperature voltage table and the temperature sensing signal in response to a status variation of the CPU performance status.

* * * * *